US011170702B2

(12) United States Patent
Yeh et al.

(10) Patent No.: US 11,170,702 B2
(45) Date of Patent: Nov. 9, 2021

(54) LIGHT-EMITTING DIODE DRIVING APPARATUS AND LIGHT-EMITTING DIODE DRIVER

(71) Applicant: Novatek Microelectronics Corp., Hsinchu (TW)

(72) Inventors: Che-Wei Yeh, Hsinchu (TW); Keko-Chun Liang, Hsinchu (TW); Yu-Hsiang Wang, Hsinchu (TW); Po-Hsiang Fang, Hsinchu (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/004,025

(22) Filed: Aug. 27, 2020

(65) Prior Publication Data

US 2021/0049956 A1 Feb. 18, 2021

Related U.S. Application Data

(63) Continuation-in-part of application No. 16/866,551, filed on May 5, 2020, now abandoned.

(60) Provisional application No. 62/885,828, filed on Aug. 13, 2019.

(30) Foreign Application Priority Data

Aug. 12, 2020 (TW) ..... 109127402

(51) Int. Cl.
*G09G 3/32* (2016.01)

(52) U.S. Cl.
CPC ..... *G09G 3/32* (2013.01); *G09G 2300/0857* (2013.01); *G09G 2310/027* (2013.01); *G09G 2310/08* (2013.01)

(58) Field of Classification Search
CPC ..... G09G 2310/027; G09G 2310/08; G09G 2300/0857; G09G 3/32
See application file for complete search history.

(56) References Cited

U.S. PATENT DOCUMENTS

| | | | |
|---|---|---|---|
| 7,023,232 | B2 | 4/2006 | Yano et al. |
| 8,321,714 | B2 | 11/2012 | Wu et al. |
| 8,334,662 | B2 | 12/2012 | Jin et al. |
| 8,963,810 | B2 | 2/2015 | Li et al. |

(Continued)

FOREIGN PATENT DOCUMENTS

| | | |
|---|---|---|
| TW | 200502555 | 1/2005 |
| TW | 201110811 | 3/2011 |

(Continued)

OTHER PUBLICATIONS

"Office Action of Taiwan Counterpart Application", dated Apr. 27, 2021, p. 1-p. 4.

*Primary Examiner* — Muhammad N Edun
(74) *Attorney, Agent, or Firm* — JCIPRNET

(57) ABSTRACT

A LED driving apparatus with differential signal interfaces is introduced, including: N-stages LED drivers, wherein the first stage LED driver receives a first data packet differential signal and a first clock differential signal and outputs a second data packet differential signal and a second clock differential signal, the Mth stage LED driver receives a Mth data packet differential signal and a Mth clock differential signal and outputs a (M+1)th data packet differential signal and a (M+1)th clock differential signal.

31 Claims, 13 Drawing Sheets

(56) References Cited

U.S. PATENT DOCUMENTS

| | | | | |
|---|---|---|---|---|
| 8,963,811 | B2 | 2/2015 | Li et al. | |
| 9,089,027 | B2 | 7/2015 | Li et al. | |
| 9,451,664 | B2 | 9/2016 | Jin et al. | |
| 9,907,129 | B2 | 2/2018 | Dann et al. | |
| 2004/0196049 | A1* | 10/2004 | Yano | G09G 3/2085 324/523 |
| 2005/0017778 | A1* | 1/2005 | Nogawa | G09G 3/32 327/165 |
| 2011/0062872 | A1* | 3/2011 | Jin | H05B 45/46 315/122 |
| 2012/0017108 | A1* | 1/2012 | Wu | H05B 45/30 713/400 |
| 2015/0076999 | A1* | 3/2015 | Malinin | H05B 45/24 315/186 |

FOREIGN PATENT DOCUMENTS

| | | |
|---|---|---|
| TW | 201206241 | 2/2012 |
| TW | 201811115 | 3/2018 |
| TW | M606400 | 1/2021 |

* cited by examiner

LIGHT-EMITTING DIODE DRIVING APPARATUS AND LIGHT-EMITTING DIODE DRIVER

CROSS-REFERENCE TO RELATED APPLICATION

This application is a continuation-in-part application of and claims the priority benefit of a prior application Ser. No. 16/866,551, filed on May 5, 2020, which claims the priority benefit of U.S. provisional application Ser. No. 62/885,828, filed on Aug. 13, 2019. This application also claims the priority benefit of Taiwan application serial no. 109127402, filed on Aug. 12, 2020. The entirety of each of the above-mentioned patent applications is hereby incorporated by reference herein and made a part of this specification.

BACKGROUND

Technical Field

The disclosure relates to a light-emitting diode (LED) driving apparatus.

Description of Related Art

Generally, a cascaded LED driver transmission interface is used in a LED display system. In the cascaded LED driver transmission interface, clock and data signals transmission speed are limited due to voltage swing range of the clock and data signals, parasitic capacitance of the clock signal lines, and environmental noise since the clock and data signals are single-ended signals. In addition, skews between the clock signal and the data signal in each of the cascaded LED drivers may cause another issue and further limit the transmission speed of the data signal and the clock signal.

As demand for high resolution and better performance of the LED display system has grown recently, there has grown a need for a more creative technique to enhance the transmission speed of the data and clock signals with the usage of de-skew of the data and clock signals for the cascaded LED driver.

Nothing herein should be construed as an admission of knowledge in the prior art of any portion of the present disclosure.

SUMMARY

A LED driving apparatus with differential signal interface and de-skew of the data and clock signals for the cascaded LED drivers is introduced. In addition, the LED driving apparatus reduce power consumption and chip area by sequentially enable the cascaded LED drivers without using FIFO memory in the cascaded LED drivers.

In an embodiment of the disclosure, the LED driving apparatus includes a controller outputting a first data packet differential signal and a first clock differential signal; N-stages LED drivers, wherein the first stage LED driver receives the first data packet differential signal and the first clock differential signal and outputs a second data packet differential signal and a second clock differential signal, the Mth stage LED driver receives a Mth data packet differential signal and a Mth clock differential signal and outputs a (M+1)th data packet differential signal and a (M+1)th clock differential signal.

In an embodiment of the disclosure, the LED driver includes a differential-input (DI) data packet signal receiver, receiving a data packet differential signal; a DI clock signal receiver, receiving a clock differential signal; a differential-output (DO) data packet signal transmitter, outputting a next stage data packet differential signal; a DO clock signal transmitter, outputting a next stage clock differential signal; and a timing control circuit, controlling output timing of the next stage data packet differential signal and the next stage clock differential signal according to the data packet differential signal and the clock differential signal.

To sum up, in the LED driving apparatus provided by the disclosure, the cost of chip area and power consumption are reduced by sequentially enable the cascaded LED drivers without using FIFO memory in the cascaded LED drivers and the transmission speed of the data signal and clock signals are enhanced by using differential signal interface and de-skew of the data and clock signals for the cascaded LED drivers.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Embodiments of the disclosure are described hereinafter with reference to the drawings.

Figure 1:
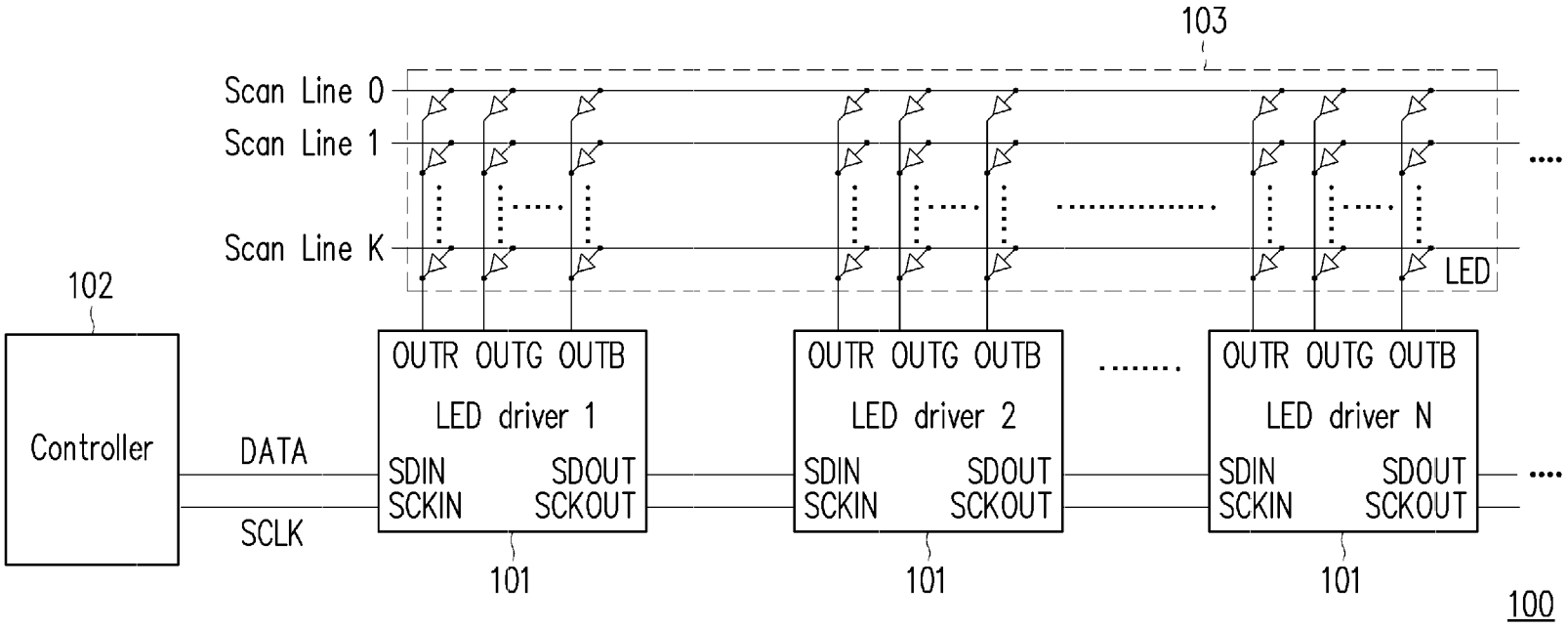
FIG. 1 is a schematic diagram of a light-emitting diode (LED) driving apparatus according to an embodiment of the disclosure.

FIG. 1 is a schematic diagram of a LED driving apparatus 100 according to an embodiment of the disclosure. The LED driving apparatus 100 includes a plurality of LED drivers 101, a controller 102, and a plurality of LEDs 103. The plurality of LED drivers 101 include cascaded N stages LED drivers from LED driver 1 to LED driver N, and N is a positive integer. The controller 102 outputs an data signal DATA including a first data packet differential signal and a clock signal SCLK including a first clock differential signal to the first stage LED driver 1, the first stage LED driver 1 receives the first data packet differential signal and the first clock differential signal and outputs a second data packet differential signal and a second clock differential signal to the second stage LED driver 2, and the Mth stage LED driver M receives a Mth data packet differential signal and a Mth clock differential signal and outputs a (M+1)th data packet differential signal and a (M+1)th clock differential signal, and M and N are positive integers, M is equal to or less than N. A frequency of the Mth data packet differential signal is K times of a frequency of the Mth clock differential signal, and K is a real number.

Figure 2A:
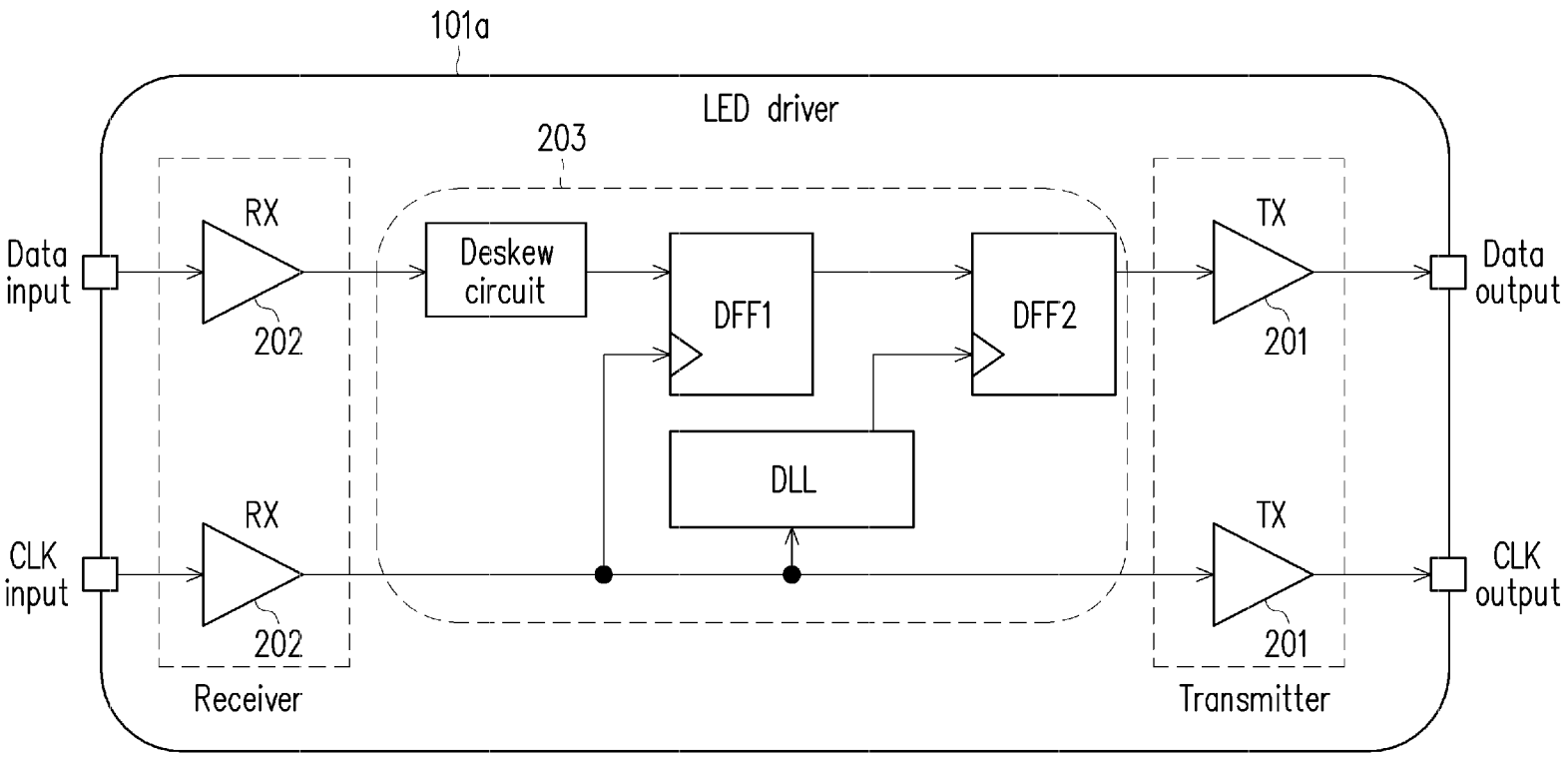
FIG. 2A~FIG. 2C are schematic diagrams of LED drivers in the LED driving apparatus according to different embodiments of the disclosure.
Figure 2B:
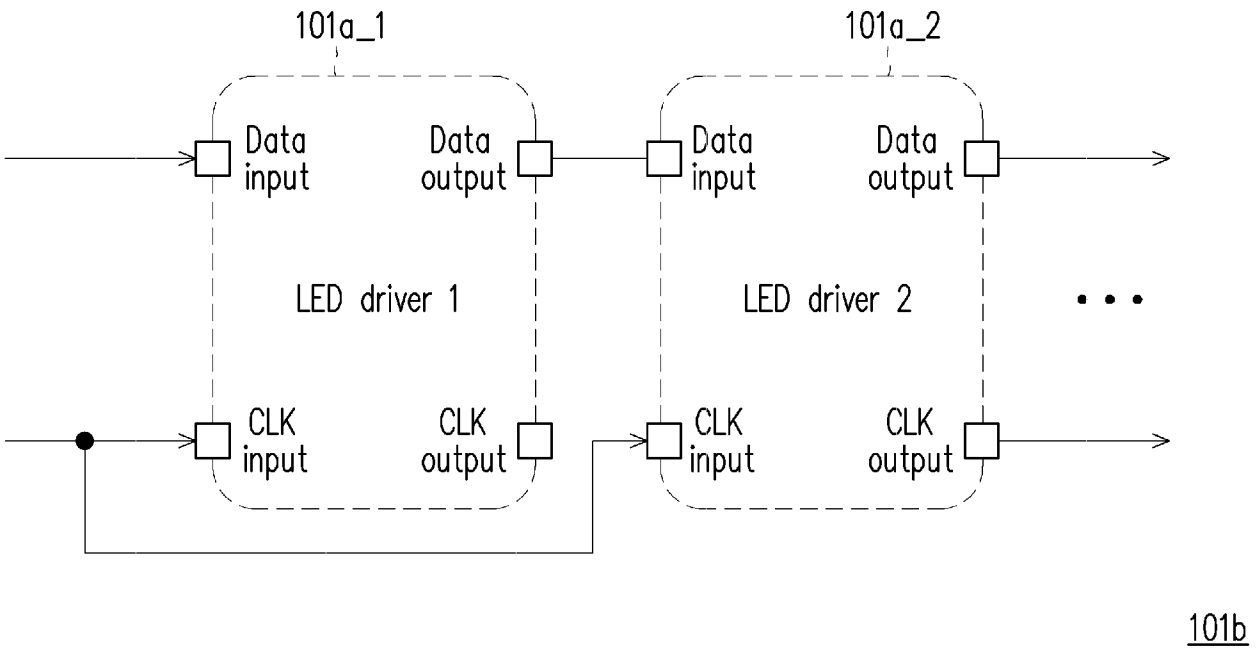
Figure 2C:
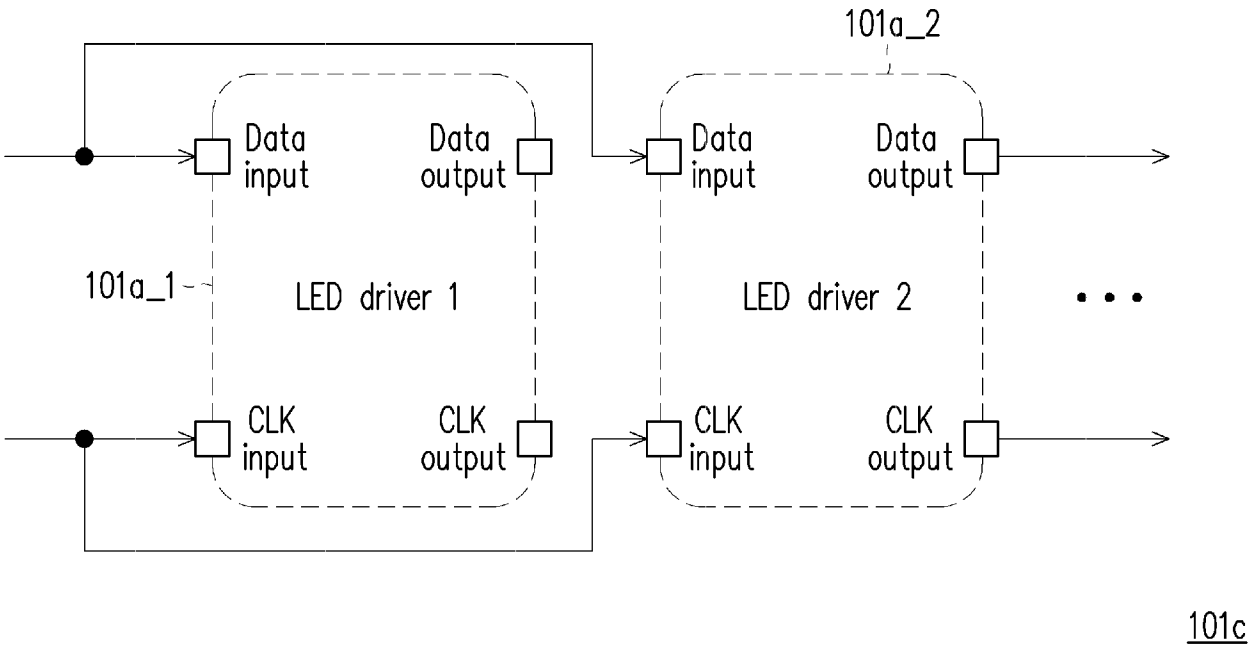

FIG. 2A is a schematic diagram of a LED driver 101*a* in the LED driving apparatus 100 according to an embodiment of the disclosure. As shown in FIG. 1 and FIG. 2A, the Mth stage LED driver M includes differential-input (DI) receivers (RX) 202, a timing control circuit 203, and differential-output (DO) transmitters (TX) 201. The DI RX 202 in the LED driver M receives the Mth data packet differential signal and the Mth clock differential signal, wherein outputs of the DI RX 202 are coupled to inputs of the timing control circuit 203, and inputs of the DO TX 201 are coupled to outputs of the timing control circuit 203. The LED driver M transmit the (M+1)th data packet differential signal and the (M+1)th clock differential signal to a LED driver (M+1). The timing control circuit 203 controls output timing of the (M+1)th data packet differential signal and the (M+1)th clock differential signal according to the Mth data packet differential signal and the Mth clock differential signal. FIG. 2B is a schematic diagram of a LED driver 101*b* in the LED driving apparatus 100 according to another embodiment of the disclosure. As shown in FIG. 1 and FIG. 2B, the LED driver 101*b* includes but not limited to two LED driver 101*a* (LED driver 1 101*a*_1 and LED driver 2 101*a*_2). The data input terminal of the LED driver 1 101*a*_1 receives a first data packet differential signal, the clock input terminals of the LED driver 1 101*a*_1 and the LED driver 2 101*a*_2 receive a first clock differential signal, the data output terminal of the LED driver 1 101*a*_1 outputs a second data packet differential signal, the data input terminal of the LED driver 2 101*a*_2 receives the second data packet differential signal, the data output terminal of the LED driver 2 101*a*_2 outputs a third data packet differential signal, the clock output terminal of the LED driver 2 101*a*_2 outputs a third clock differential signal. FIG. 2C is a schematic diagram of a LED driver 101*c* in the LED driving apparatus 100 according to another embodiment of the disclosure. As shown in FIG. 1 and FIG. 2C, the LED driver 101*c* includes but not limited to two LED driver 101*a* (LED driver 1 101*a*_1 and LED driver 2 101*a*_2). The data input terminals of the LED driver 1 101*a*_1 and the LED driver 2 101*a*_2 receive a first data packet differential signal, the clock input terminals of the LED driver 1 101*a*_1 and the LED driver 2 101*a*_2 receive a first clock differential signal, the data output terminal of the LED driver 2 101*a*_2 outputs a third data packet differential signal, the clock output terminal of the LED driver 2 101*a*_2 outputs a third clock differential signal.

As shown in FIG. 2A, the timing control circuit 203 includes a de-skew circuit with an input coupling to a first output of the DI RX 202; a delay-locked loop DLL circuit with an input coupling to a second output of the DI RX 202 and an second input of the DO TX 201; a first register DFF1 with a first input coupling to an output of the de-skew circuit and a second input coupling to the second output of the DI RX 202; and a second register DFF2 with a first input coupling to an output of the first register DFF1 and a second input coupling to an output of the DLL circuit and an output coupling to an first input of the DO TX 201.

Figure 3:
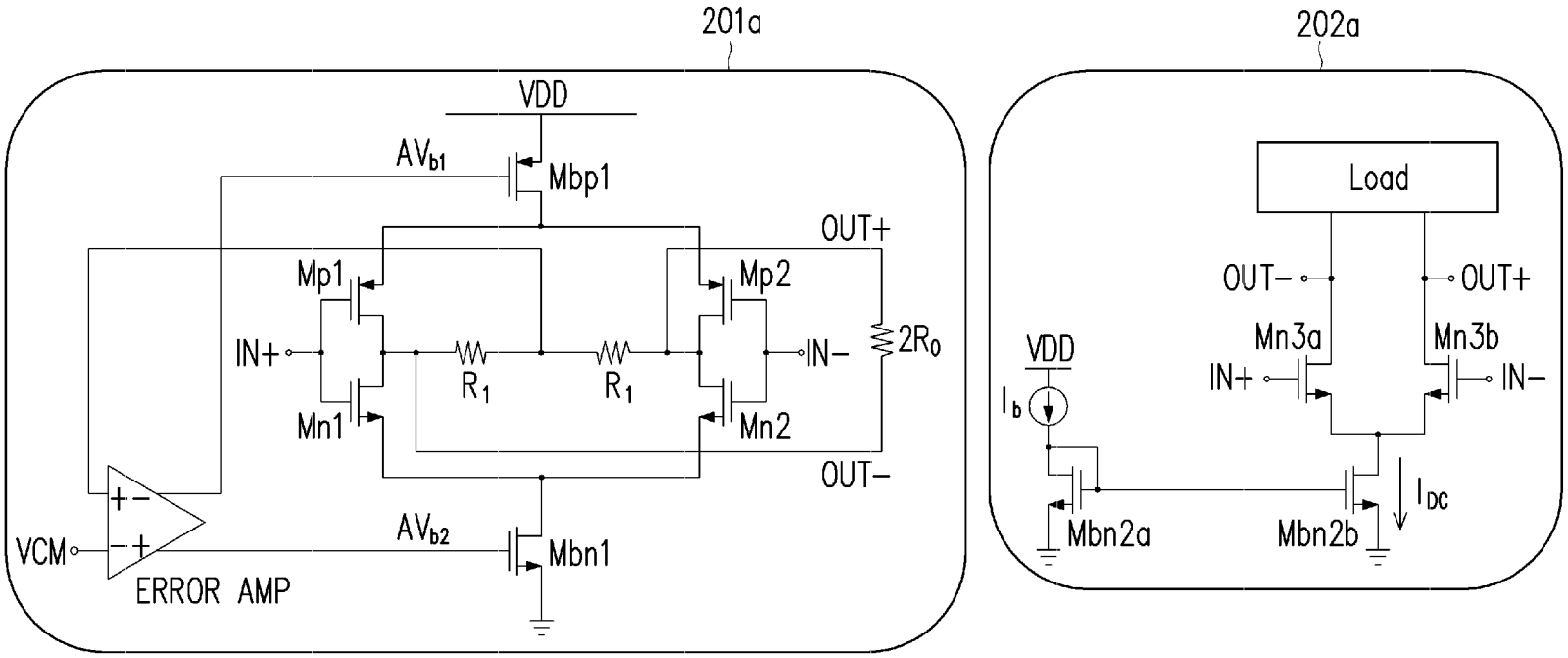
FIG. 3 is a schematic diagram of a transmitter (TX) and a receiver (RX) in the LED driving apparatus according to another embodiment of the disclosure.

FIG. 3 is a schematic diagram of a DO TX 201*a* and a DI RX 202*a* of the Mth stage LED driver M in the LED driving apparatus 100 according to another embodiment of the disclosure. The DI RX 202*a* of the Mth stage LED driver M includes a current mirror circuit including a current source $I_b$, a N-type metal oxide semiconductor (NMOS) transistor Mbn2*a* and a NMOS transistor Mbn2*b*, providing a first bias current $I_{DC}$; a pair of source-coupled transistors including a NMOS transistor Mn3*a* and a NMOS transistor Mn3*b*, coupling to the current mirror circuit and receiving the Mth data packet differential signal and the Mth clock differential signal with differential inputs IN+ and IN− and outputting from differential outputs OUT+ and OUT−; a load circuit coupling to the pair of source-coupled transistors and adjusting a voltage signal swing range of the differential outputs OUT+ and OUT−, the DI RX 202*a* may also be a receiver with a single-ended output.

The DO TX 201*a* of the Mth stage LED driver M includes an error amplifier outputting a first error voltage signal $AV_{b1}$ and a second error voltage signal $AV_{b2}$ according to a common mode voltage VCM signal; a bias current control circuit including a NMOS transistor Mbn1 and a P-type metal oxide semiconductor (PMOS) transistor Mbp1, providing a second bias current according to the first error voltage signal $AV_{b1}$ and the second error voltage signal $AV_{b2}$; and a differential-input differential-output (DIDO) inverter including NMOS transistors Mn1,Mn2 and PMOS transistors Mp1, Mp2 with differential inputs IN+ and IN− coupling to the DI RX 202*a*, and outputting the (M+1)th data packet differential signal and the (M+1)th clock differential signal from differential outputs OUT+ and OUT−. Resistors $R_1$ are used to sense common mode voltages of the (M+1)th data packet differential signal and the (M+1)th clock differential signal and feedback the sensed common mode voltages to a non-inverting input of the error amplifier. Resistors $2R_0$ are used to match an output impedance of the DO TX 201*a* of the Mth stage LED driver M and an input impedance of the DI RX 202*a* of the (M+1)th stage LED driver (M+1), the DO TX 201*a* may also be a transmitter with a single-ended input.

Figure 4:
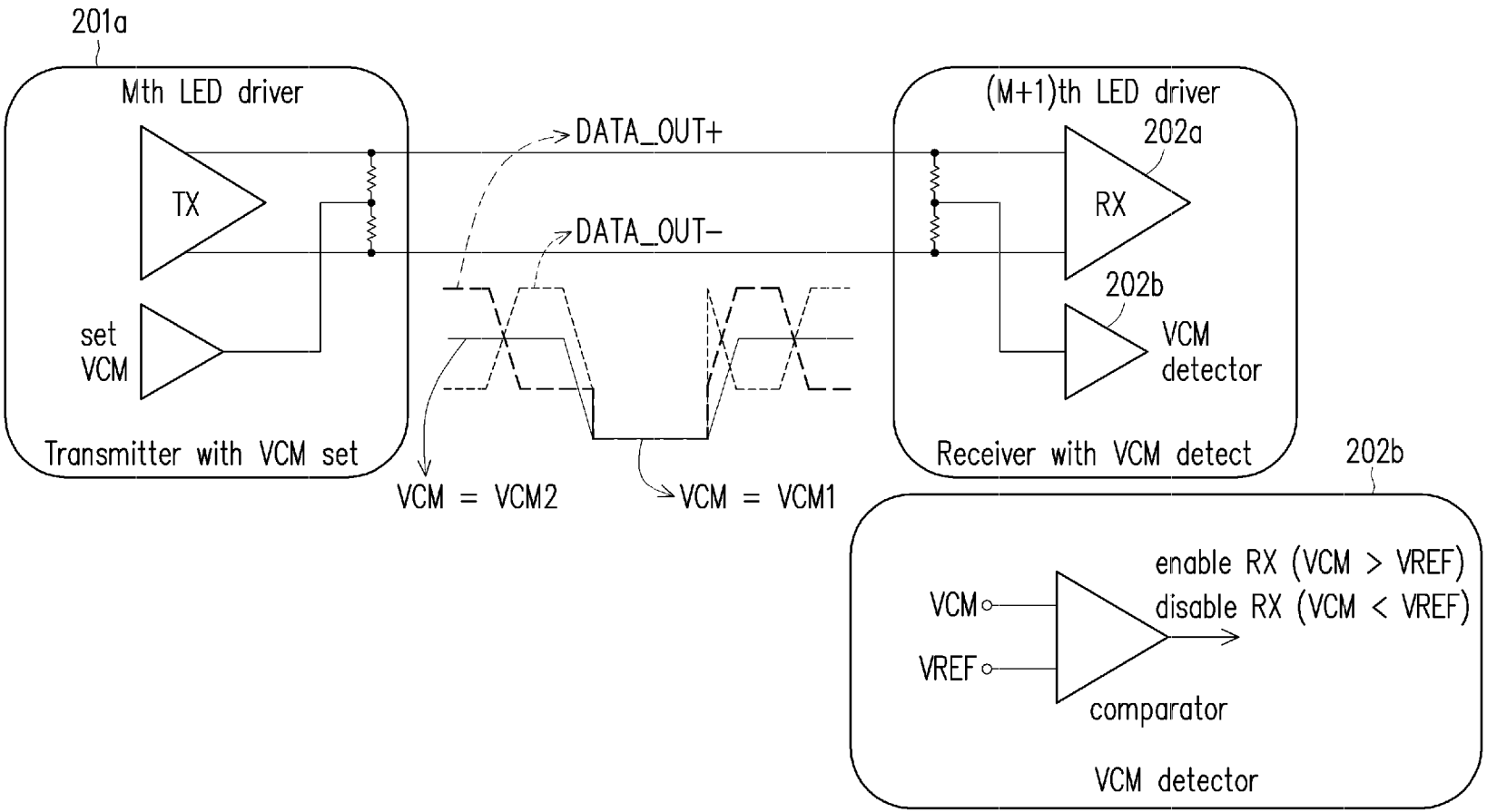
FIG. 4 is a schematic diagram of a differential signal transmission between a TX in a Mth stage LED driver and a RX in a (M+1)th stage LED driver in the LED driving apparatus according to another embodiment of the disclosure.

FIG. 4 is a schematic diagram of a differential signal transmission between the DO TX 201*a* in the Mth stage LED driver M and the DI RX 202*a* in the (M+1)th stage LED driver (M+1) in the LED driving apparatus 100 according to another embodiment of the disclosure. DATA_OUT+ and DATA_OUT− (i.e. the (M+1)th data packet differential signal) are used as an example of data signal transmission between the Mth stage LED driver M and the (M+1)th stage LED driver (M+1) in the LED driving apparatus 100, but not limited to thereto. The Mth stage LED driver M sets the common mode voltage of the (M+1)th data packet differential signal by setting the common mode voltage VCM signal as an input signal to an inverting input of the error amplifier of the DO TX 201*a*. As shown in FIG. 4, the Mth stage LED driver M sets the common mode voltage of the (M+1)th data packet differential signal from VCM2 to VCM1 and from VCM1 to VCM2.

The DI RX 202*a* in the (M+1)th stage LED driver (M+1) receives the (M+1)th data packet differential signal and a VCM detector 202*b* detects a common mode voltage level of the (M+1)th data packet differential signal. The VCM detector 202*b* includes a comparator comparing the common mode voltage level of the (M+1)th data packet differential signal to a reference voltage level VREF and enables the DI RX 202*a* when the common mode voltage level of the (M+1)th data packet differential signal is greater than the reference voltage level VREF.

Figure 5:
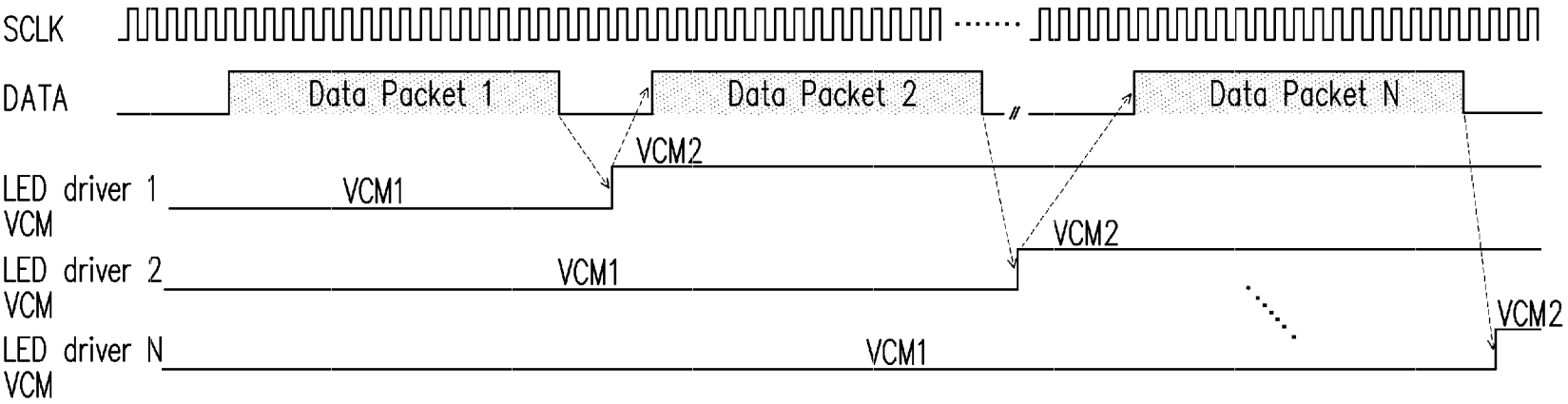
FIG. 5 is signal flows of common mode voltage VCM signals of the LED drivers and clock signals SCLK and data signals DATA in the LED driving apparatus according to an embodiment of the disclosure.

FIG. 5 is signal flows of common mode voltage VCM signals of the LED drivers 1~N and clock signals SCLK and data signals DATA in the LED driving apparatus 100 according to an embodiment of the disclosure. As shown in FIG. 1 and FIG. 5, the controller 102 outputs the first data packet differential signal (Data Packet 1) to the first stage LED driver 1, the first stage LED driver 1 sets the common mode voltage VCM signal of the first stage LED driver 1 from VCM1 to VCM2 after the first stage LED driver 1 received the Data Packet 1, and the first stage LED driver 1 outputs the second data packet differential signal (Data Packet 2) to the second stage LED driver 2 after the first stage LED driver 1 sets the common mode voltage VCM signal of the first stage LED driver 1 from VCM1 to VCM2. The second stage LED driver 2 sets the common mode voltage VCM signal of the second stage LED driver 2 from VCM1 to VCM2 after the second stage LED driver 2 received the Data Packet 2, and so on.

Figure 6:
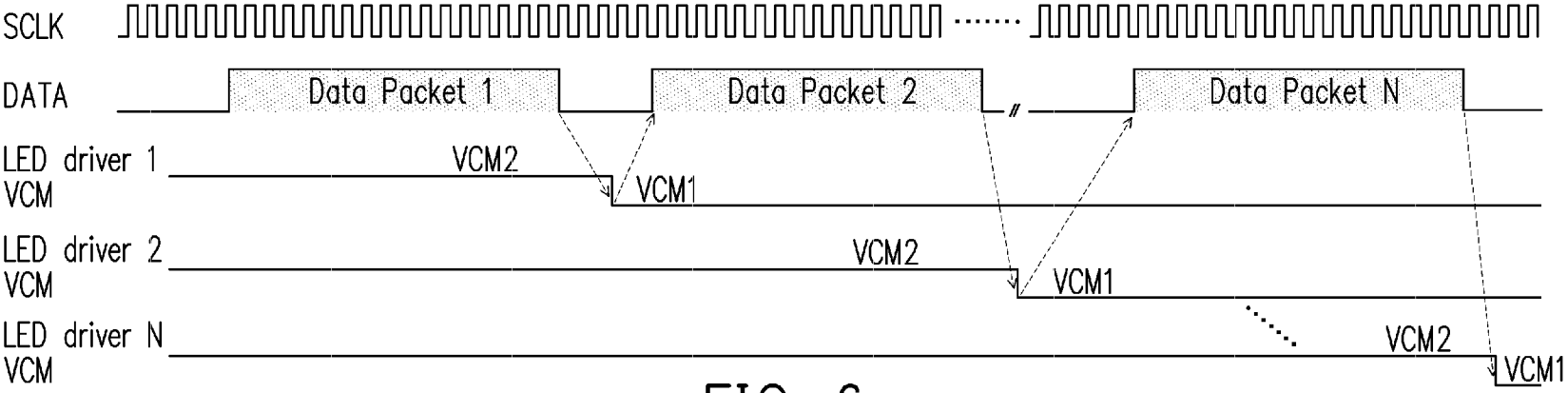
FIG. 6 is signal flows of VCM signals of the LED drivers and clock signals SCLK and data signals DATA in the LED driving apparatus according to another embodiment of the disclosure.

FIG. 6 is signal flows of common mode voltage VCM signals of the LED drivers 1~N and clock signals SCLK and data signals DATA in the LED driving apparatus 100 according to another embodiment of the disclosure. As shown in FIG. 1 and FIG. 6, the controller 102 readbacks the first data packet differential signal (Data Packet 1) from the first stage LED driver 1, the first stage LED driver 1 sets the common mode voltage VCM signal of the first stage LED driver 1 from VCM2 to VCM1 after the controller 102 readbacked the Data Packet 1, and the controller 102 readbacks the second data packet differential signal (Data Packet 2) from the second stage LED driver 2 after the first stage LED driver 1 sets the common mode voltage VCM signal of the first stage LED driver 1 from VCM2 to VCM1. The second stage LED driver 2 sets the common mode voltage VCM signal of the second stage LED driver 2 from VCM2 to VCM1 after the controller 102 readbacked the Data Packet 2, and so on.

Figure 7:
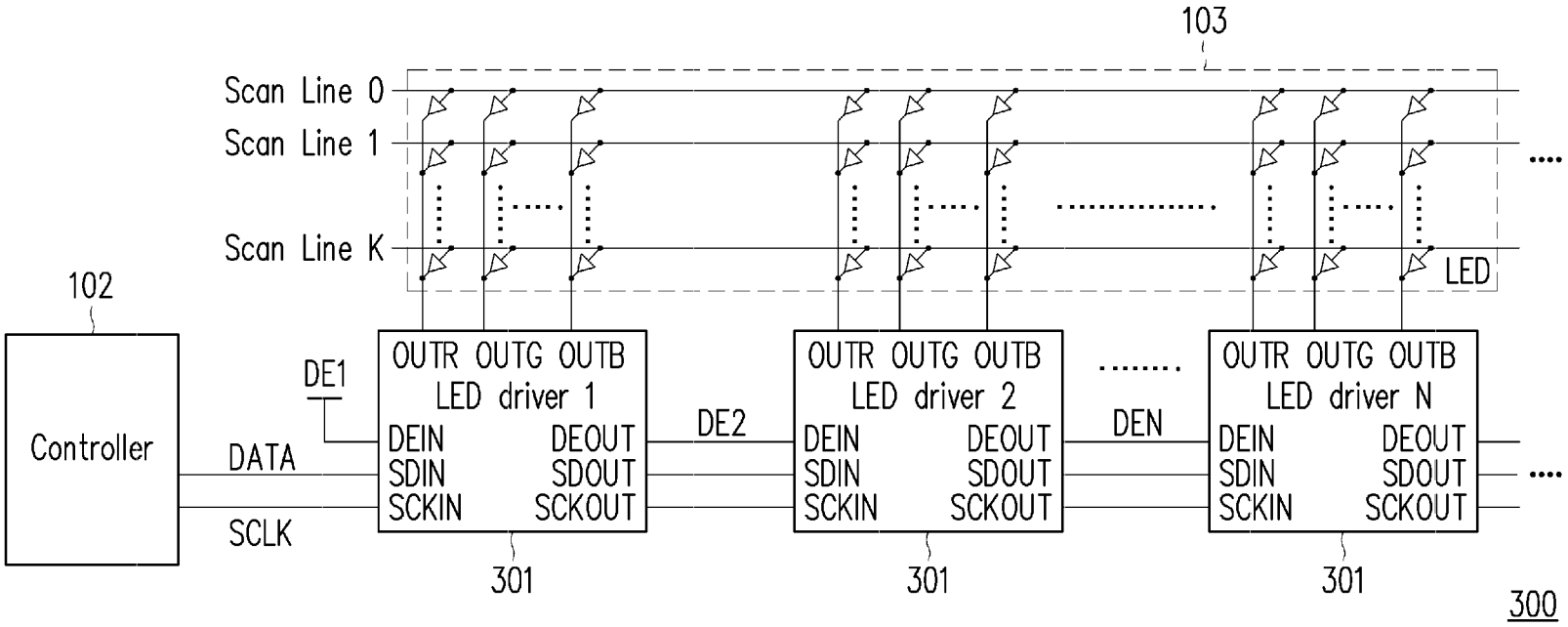
FIG. 7 is a schematic diagram of a LED driving apparatus according to another embodiment of the disclosure.

FIG. 7 is a schematic diagram of a LED driving apparatus 300 according to another embodiment of the disclosure. Comparing to LED driving apparatus 100 shown in FIG. 1, the LED driver 301 further includes a DEIN input and a DEOUT output, and a signal DEM is an enable signal of the Mth stage LED driver M. As shown in FIG. 7, the Mth stage LED driver M receives an enable signal DEM and output an enable signal DE(M+1) to enable the (M+1)th stage LED driver (M+1).

Figure 8:
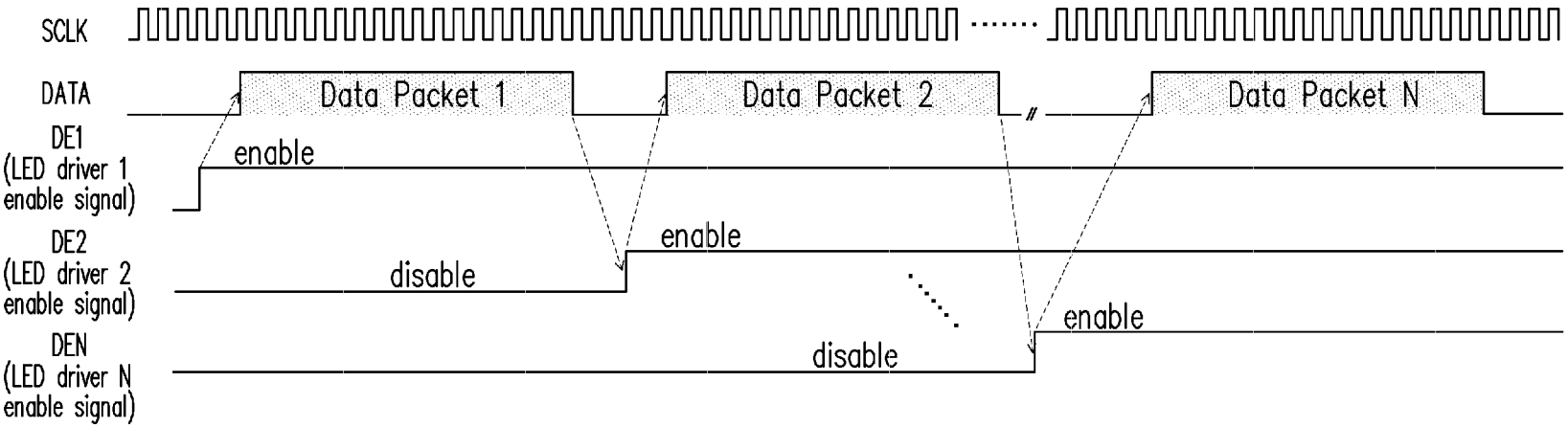
FIG. 8 is signal flows of enable signals DE of the LED drivers and clock signals SCLK and data signals DATA in the LED driving apparatus according to an embodiment of the disclosure.

FIG. 8 is signal flows of enable signals DE of the LED drivers 301 and clock signals SCLK and data signals DATA in the LED driving apparatus 300 according to an embodiment of the disclosure. As shown in FIG. 7 and FIG. 8, the enable signal DE1 initially enables the first stage LED driver 1, and the controller 102 outputs the first data packet differential signal (Data Packet 1) to the first stage LED driver 1, the first stage LED driver 1 enables the second stage LED driver 2 after the first stage LED driver 1 received the Data Packet 1, and the first stage LED driver 1 outputs the second data packet differential signal (Data Packet 2) to the second stage LED driver 2 after the first stage LED driver 1 enables the second stage LED driver 2. The second stage LED driver 2 enables the third stage LED driver 3 after the second stage LED driver 2 received the Data Packet 2, and so on.

In another embodiment of the disclosure, as shown in FIG. 7 and FIG. 8, the enable signal DE1 initially enables the first stage LED driver 1, and the controller 102 readbacks the first data packet differential signal (Data Packet 1) from the first stage LED driver 1, the first stage LED driver 1 enables the second stage LED driver 2 after the controller 102 readbacked the Data Packet 1 from the first stage LED driver 1, and the controller 102 readbacks the second data packet differential signal (Data Packet 2) from the second stage LED driver 2 after the first stage LED driver 1 enables the second stage LED driver 2. The second stage LED driver 2 enables the third stage LED driver 3 after the controller 102 readbacked the Data Packet 2 from the second stage LED driver 2, and so on.

Figure 9:
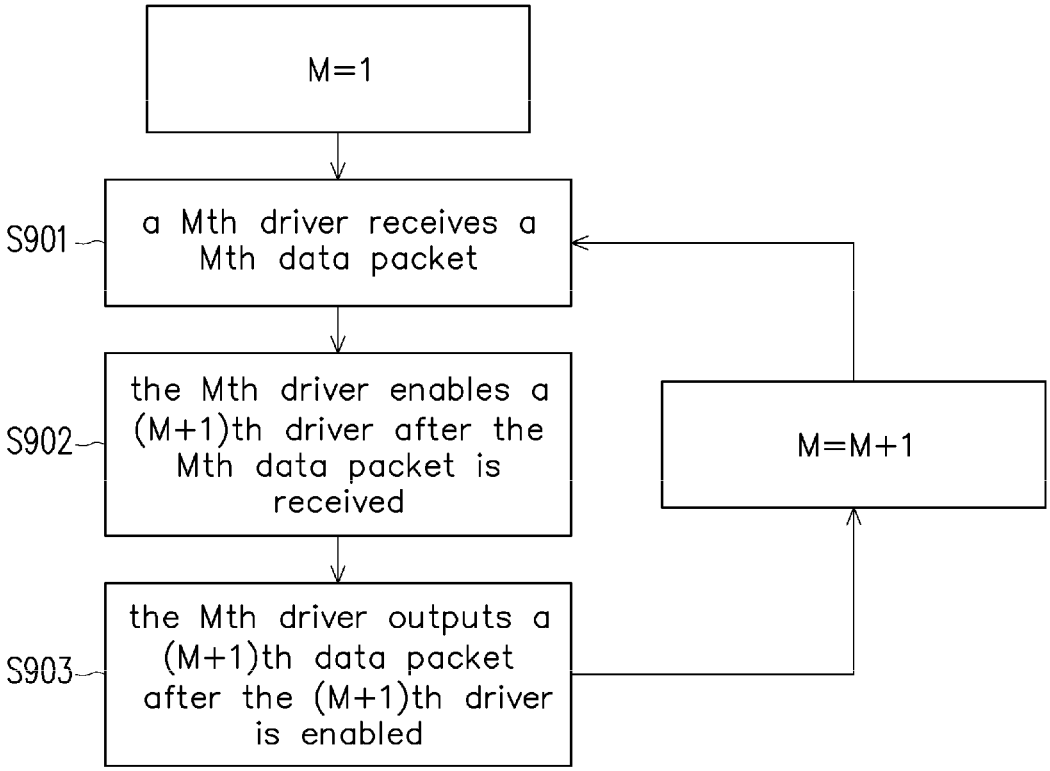
FIG. 9 is a flowchart of sequentially enable the LED drivers in the LED driving apparatus according to an embodiment of the disclosure.

FIG. 9 is a flowchart of sequentially enable the LED drivers in the LED driving apparatus 300 according to an embodiment of the disclosure. In step S901, a Mth stage LED driver M receives a Mth data packet differential signal. In step S902, the Mth stage LED driver M enables the a (M+1)th stage LED driver (M+1) after the Mth data packet differential signal is received. In step S903, the Mth stage LED driver M outputs a (M+1)th data packet differential signal after the (M+1)th stage LED driver (M+1) is enabled.

Figure 10:
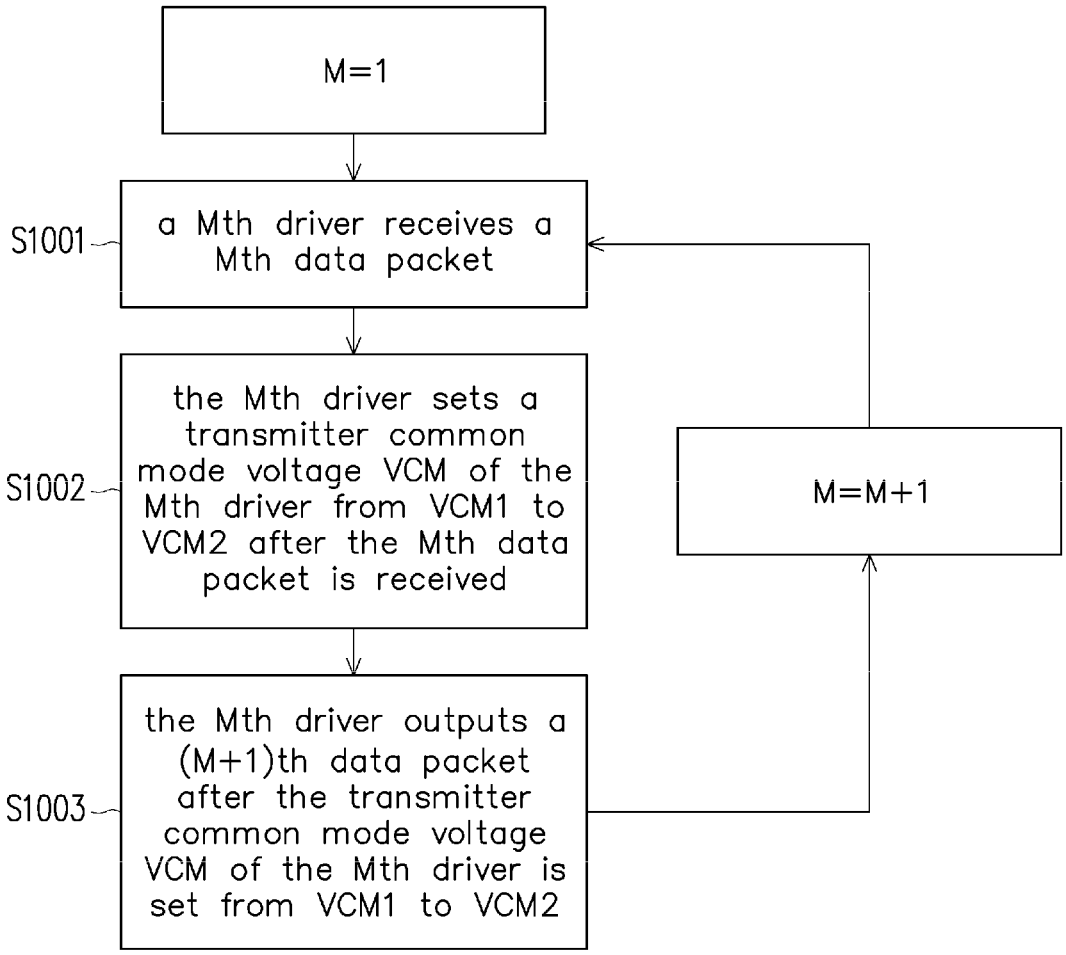
FIG. 10 is a flowchart of sequentially set TX VCM signals of the LED drivers in the LED driving apparatus according to an embodiment of the disclosure.

FIG. 10 is a flowchart of sequentially set TX VCM signals of the LED drivers in the LED driving apparatus 100 according to an embodiment of the disclosure. In step S1001, a Mth stage LED driver M receives a Mth data packet differential signal. In step 1002, the Mth stage LED driver M sets a transmitter common mode voltage VCM of the Mth stage LED driver M from VCM1 to VCM2 after the Mth data packet differential signal is received. In step S1003, the Mth stage LED driver M outputs a (M+1)th data packet differential signal after the transmitter common mode voltage VCM of the Mth stage LED driver M is set from VCM1 to VCM2.

Figure 11:
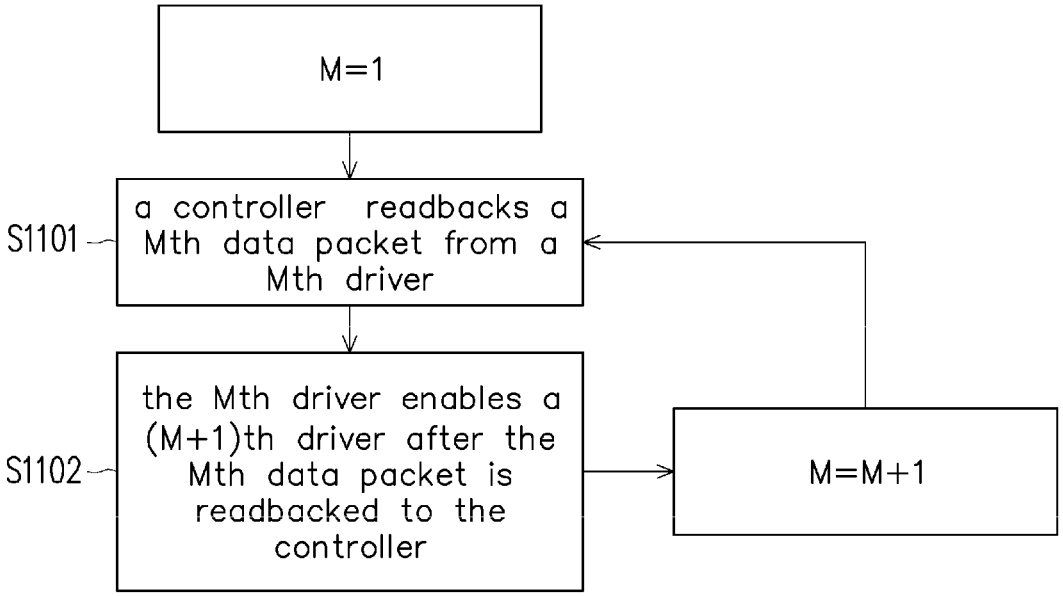
FIG. 11 is a flowchart of sequentially enable the LED drivers in the LED driving apparatus according to another embodiment of the disclosure.

FIG. 11 is a flowchart of sequentially enable the LED drivers in the LED driving apparatus 300 according to another embodiment of the disclosure. In step S1101, a controller 102 readbacks a Mth data packet differential signal from a Mth stage LED driver M. In step S1102, the Mth stage LED driver M enables a (M+1)th stage LED driver (M+1) after the Mth data packet differential signal is readbacked to the controller 102.

Figure 12:
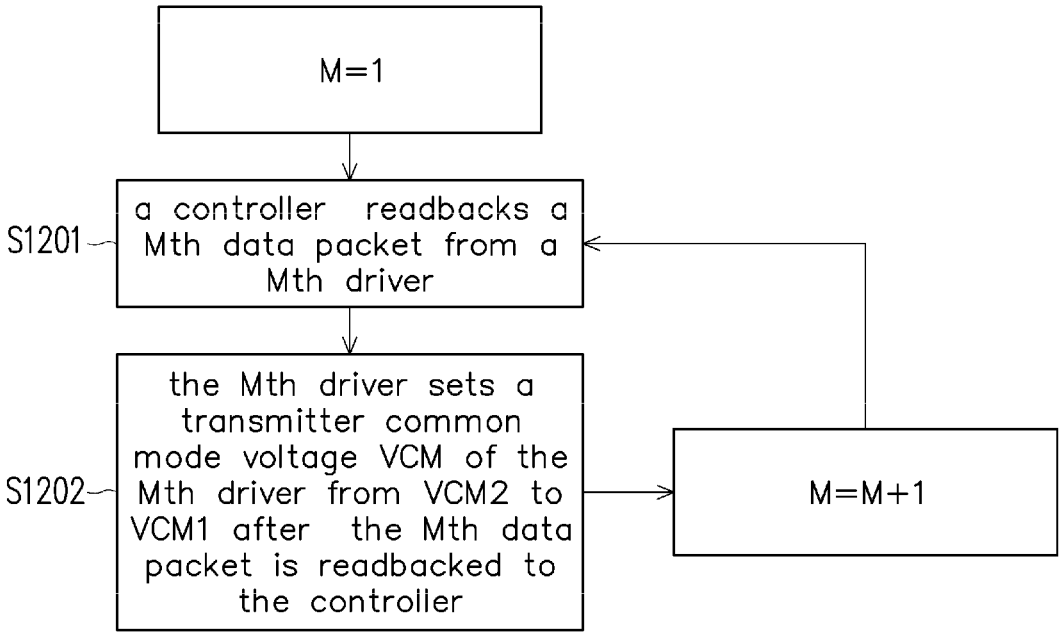
FIG. 12 is a flowchart of sequentially set TX VCM signals of the LED drivers in the LED driving apparatus according to another embodiment of the disclosure.

FIG. 12 is a flowchart of sequentially set TX VCM signals of the LED drivers in the LED driving apparatus 100 according to another embodiment of the disclosure. In step S1201, a controller 102 readbacks a Mth data packet differential signal from a Mth stage LED driver M. In step S1202, the Mth stage LED driver M sets a transmitter common mode voltage VCM of the Mth stage LED driver M from VCM2 to VCM1 after the Mth data packet differential signal is readbacked to the controller 102.

Figure 13:
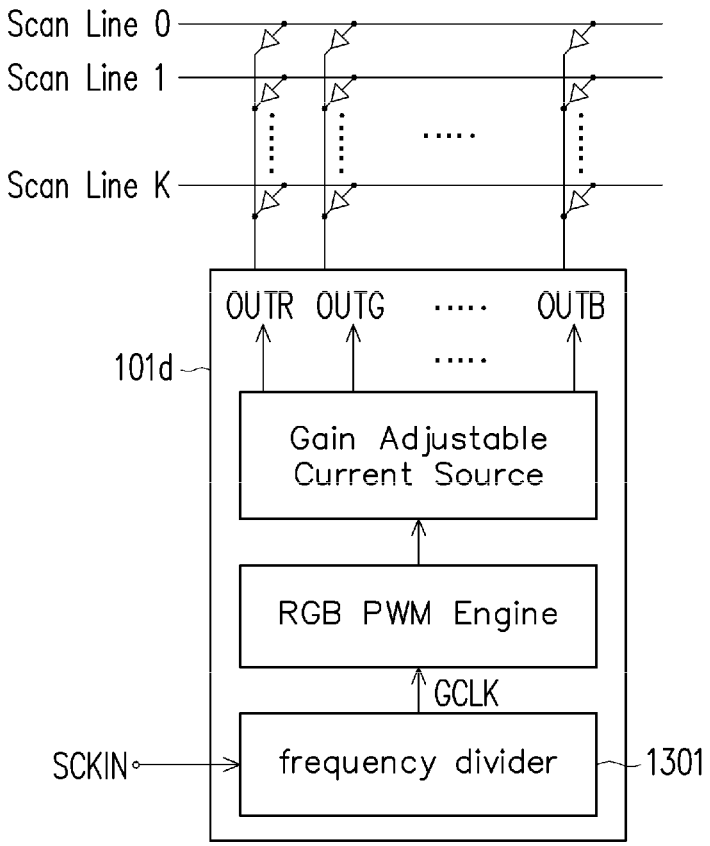
FIG. 13 is a schematic diagram of a LED driver in the LED driving apparatus according to another embodiment of the disclosure.

FIG. 13 is a schematic diagram of a LED driver 101*d* in the LED driving apparatus 100 according to another embodiment of the disclosure. The Mth stage LED driver M may further include a frequency divider 1301, a RGB PWM engine and a gain adjustable current source. The Mth stage LED driver M receives the Mth clock differential signal (i.e. SCKIN) and divides a frequency of the Mth clock differential signal to output a signal GCLK with the frequency divider 1301. The signal GCLK (i.e. gray code clock) may be a single-ended signal or a differential signal to drive the RGB PWM engine to generate different pulse width signals corresponding to different RGB data signals to control a grayscale value of the plurality of LEDs 103.

Figure 14:
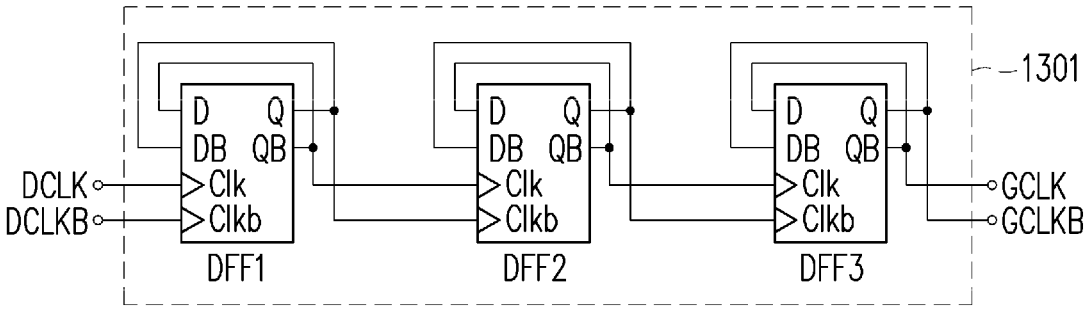
FIG. 14 is a schematic diagram of a frequency divider according to another embodiment of the disclosure.

FIG. 14 is a schematic diagram of the frequency divider 1301 according to another embodiment of the disclosure. A dividing number of the frequency divider 1301 may be a rational number expressed as N1/N2, N1 and N2 are two positive integers. For example, the frequency divider 1301 may include a number of P (i.e. P is an integer equal to or greater than 1) cascaded DFF (i.e. D-type flip flop) to perform a frequency dividing operation with a frequency divider number $2^P$. FIG. 14 shows an example of three cascaded DFFs (i.e. DFF1, DFF2 and DFF3). An output Q of the DFF1 is coupled to an input DB of the DFF1, and an output QB of the DFF1 is coupled to an input D of the DFF1. The DFF2 and the DFF3 are configured the same with the DFF1. Each of the cascaded DFFs performs the frequency dividing operation with the frequency divider number 2, and an overall frequency divider number provided by the frequency divider 1301 is $2^3$ (i.e. the frequency of the signal GCLK (GCLK, GCLKB are differential pair) is ⅛ of a frequency of a signal DCLK (DCLK, DCLKB are differential pair).

From the above embodiments, the LED driving apparatus 100 and 300 reduce the cost of chip area and power consumption by sequentially enable the cascaded LED drivers without using FIFO memory in the cascaded LED drivers and the transmission speed of the data and clock signals are enhanced by using differential signal interface and de-skew of the data and clock signals for the cascaded LED drivers.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A Light-emitting diode (LED) driving apparatus, comprising:

N-stages LED drivers, wherein the first stage LED driver receives a first data packet differential signal and a first clock differential signal and outputs a second data packet differential signal and a second clock differential signal, the Mth stage LED driver receives a Mth data packet differential signal and a Mth clock differential signal and outputs a (M+1)th data packet differential signal and a (M+1)th clock differential signal, and M and N are positive integers, M is less than N, wherein the Mth data packet differential signal is enabled to be received according to a comparing result of a common mode voltage level of the Mth data packet differential signal and a reference voltage level.

2. The LED driving apparatus as claimed in claim 1, wherein the Mth stage LED driver further comprises:

a differential-input (DI) data packet signal receiver, receiving the Mth data packet differential signal;

a DI clock signal receiver, receiving the Mth clock differential signal;

a differential-output (DO) data packet signal transmitter, outputting the (M+1)th data packet differential signal;

a DO clock signal transmitter, outputting the (M+1)th clock differential signal; and a timing control circuit, controlling output timing of the (M+1)th data packet differential signal and the (M+1)th clock differential signal according to the Mth data packet differential signal and the Mth clock differential signal.

3. The LED driving apparatus as claimed in claim 2, wherein the timing control circuit comprises:

a de-skew circuit, and an input of the de-skew circuit is coupled to an output of the DI data packet signal receiver;

a delay-locked loop (DLL) circuit, and an input of the DLL circuit is coupled to an output of the DI clock signal receiver and an input of the DO clock signal transmitter;

a first register, and inputs of the first register are coupled to an output of the de-skew circuit and the output of the DI clock signal receiver; and a second register, and inputs of the second register are coupled to an output of the first register and an output of the DLL circuit, and an output of the second register is coupled to an input of the DO data packet signal transmitter.

4. The LED driving apparatus as claimed in claim 2, wherein the DI data packet signal receiver comprises:

a current mirror circuit, providing a first bias current;

a pair of source-coupled transistors, coupling to the current mirror circuit and receiving the Mth data packet differential signal;

a load circuit, coupling to the pair of source-coupled transistors; and a common mode voltage detector, enabling the DI data packet signal receiver according to the common mode voltage level of the Mth data packet differential signal.

5. The LED driving apparatus as claimed in claim 4, wherein the common mode voltage detector comprises a comparator comparing the common mode voltage level of the Mth data packet differential signal to the reference voltage level.

6. The LED driving apparatus as claimed in claim 2, wherein the DO data packet signal transmitter comprises:

an error amplifier, outputting a first error voltage signal and a second error voltage signal according to a common mode voltage signal;

a bias current control circuit, providing a second bias current according to the first error voltage signal and the second error voltage signal; and a differential-input differential-output (DIDO) inverter, coupling to the bias current control circuit and an input of the error amplifier and outputting the (M+1)th data packet differential signal.

7. The LED driving apparatus as claimed in claim 6, wherein the Mth data packet differential signal and the (M+1)th data packet differential signal are separate in a time interval according to the common mode voltage signal, and the Mth stage LED driver set the common mode voltage signal from a first common mode voltage level to a second common mode voltage level in the time interval after the Mth stage LED driver received the Mth data packet differential signal.

8. The LED driving apparatus as claimed in claim 6, wherein the Mth data packet differential signal and the (M+1)th data packet differential signal are separate in a time interval according to the common mode voltage signal, and the Mth stage LED driver set the common mode voltage signal from a third common mode voltage level to a fourth common mode voltage level in the time interval after the controller readbacked the Mth data packet differential signal from the Mth stage LED driver.

9. The LED driving apparatus as claimed in claim 2, wherein the Mth stage LED driver outputs an enable signal in a time interval to enable a (M+1)th stage LED driver after the Mth stage LED driver received the Mth data packet differential signal.

10. The LED driving apparatus as claimed in claim 2, wherein the Mth stage LED driver outputs an enable signal in a time interval to enable a (M+1)th stage LED driver after the controller readbacked the Mth data packet differential signal from the Mth stage LED driver.

11. The LED driving apparatus as claimed in claim 1, wherein a frequency of the Mth data packet differential signal is K times of a frequency of the Mth clock differential signal, and K is a real number.

12. The LED driving apparatus as claimed in claim 1, wherein a data output terminal of the first stage LED driver couples to a data input terminal of the second stage LED driver, a clock input terminal of the first stage LED driver couples to a clock input terminal of the second stage LED driver, the first stage LED driver receives the first data packet differential signal and the first clock differential signal, the second stage LED driver outputs a third data packet differential signal and a third clock differential signal.

13. The LED driving apparatus as claimed in claim 1, wherein a data input terminal of the first stage LED driver couples to a data input terminal of the second stage LED driver, a clock input terminal of the first stage LED driver couples to a clock input terminal of the second stage LED driver, the first stage LED driver receives the first data packet differential signal and the first clock differential signal, the second stage LED driver outputs a third data packet differential signal and a third clock differential signal.

14. The LED driving apparatus as claimed in claim 1, wherein the Mth stage LED driver further comprises:

a frequency divider, receiving the Mth clock differential signal and dividing a frequency of the Mth clock differential signal to output a gray code clock to control a grayscale value of a plurality of LEDs.

15. The LED driving apparatus as claimed in claim 14, wherein a divider number of the frequency divider is a rational number equal to or greater than one.

16. The LED driving apparatus as claimed in claim 14, wherein the frequency divider comprises at least one cascaded d-type flip flop.

17. The LED driving apparatus as claimed in claim 16, wherein a divider number of the frequency divider is substantially equal to $2^P$, wherein P is a number of the at least one cascaded d-type flip flop.

18. A Light-emitting diode (LED) driver, comprising:

a differential-input (DI) data packet signal receiver, receiving a data packet differential signal;

a DI clock signal receiver, receiving a clock differential signal;

a differential-output (DO) data packet signal transmitter, outputting a next stage data packet differential signal;

a DO clock signal transmitter, outputting a next stage clock differential signal; and a timing control circuit, controlling output timing of the next stage data packet differential signal and the next stage clock differential signal according to the data packet differential signal and the clock differential signal, wherein the data packet differential signal is enabled to be received according to a comparing result of a common mode voltage level of the data packet differential signal and a reference voltage level.

19. The LED driver as claimed in claim 18, wherein the timing control circuit comprises:

a de-skew circuit, and an input of the de-skew circuit is coupled to an output of the DI data packet signal receiver;

a delay-locked loop (DLL) circuit, and an input of the DLL circuit is coupled to an output of the DI clock signal receiver and an input of the DO clock signal transmitter;

a first register, and inputs of the first register are coupled to an output of the de-skew circuit and the output of the DI clock signal receiver; and a second register, and inputs of the second register are coupled to an output first register and an output of the DLL circuit, and an output of the second register is coupled to an input of the DO data packet signal transmitter.

20. The LED driver as claimed in claim 18, wherein the DI data packet signal receiver comprises:

a current mirror circuit, providing a first bias current;

a pair of source-coupled transistors, coupling to the current mirror circuit and receiving the data packet differential signal;

a load circuit, coupling to the pair of source-coupled transistors; and a common mode voltage detector, enabling the DI data packet signal receiver according to the common mode voltage level of the data packet differential signal.

21. The LED driver as claimed in claim 20, wherein the common mode voltage detector comprises a comparator comparing the common mode voltage level of the data packet differential signal to the reference voltage level.

22. The LED driver as claimed in claim 18, wherein the DO data packet signal transmitter comprises:

an error amplifier, outputting a first error voltage signal and a second error voltage signal according to a common mode voltage signal;

a bias current control circuit, providing a second bias current according to the first error voltage signal and the second error voltage signal; and a differential-input differential-output (DIDO) inverter, coupling to the bias current control circuit and an input of the error amplifier and outputting the next stage data packet differential signal.

23. The LED driver as claimed in claim 22, wherein the data packet differential signal and the next stage data packet differential signal are separate in a time interval according to the common mode voltage signal, and the LED driver set the common mode voltage signal from a first common mode voltage level to a second common mode voltage level in the time interval after the LED driver received the data packet differential signal.

24. The LED driver as claimed in claim 22, wherein the data packet differential signal and the next stage data packet differential signal are separate in a time interval according to the common mode voltage signal, and the LED driver set the common mode voltage signal from a third common mode voltage level to a fourth common mode voltage level in the time interval after the controller readbacked the data packet differential signal from the LED driver.

25. The LED driver as claimed in claim 18, wherein the LED driver outputs an enable signal in a time interval to enable a next stage LED driver after the LED driver received the data packet differential signal.

26. The LED driver as claimed in claim 18, wherein the LED driver outputs an enable signal in a time interval to enable a next stage LED driver after the controller readbacked the data packet differential signal from the LED driver.

27. The LED driver as claimed in claim 18, wherein a frequency of the data packet differential signal is K times of a frequency of the clock differential signal, and K is a real number.

28. The LED driver as claimed in claim 18, wherein the LED driver further comprises:

a frequency divider, receiving the clock differential signal and dividing a frequency of the clock differential signal to output a gray code clock to control a grayscale value of a LED.

29. The LED driver as claimed in claim 28, wherein a divider number of the frequency divider is a rational number equal to or greater than one.

30. The LED driver as claimed in claim 28, wherein the frequency divider comprises at least one cascaded d-type flip flop.

31. The LED driver as claimed in claim 30, wherein a divider number of the frequency divider is substantially equal to $2^P$, wherein P is a number of the at least one cascaded d-type flip flop.

* * * * *